US009093751B2

(12) United States Patent
Saito et al.

(10) Patent No.: US 9,093,751 B2
(45) Date of Patent: Jul. 28, 2015

(54) GLASS ANTENNA FOR VEHICLE AND WINDOW GLASS FOR VEHICLE

(71) Applicant: Asahi Glass Company, Limited, Tokyo (JP)

(72) Inventors: Koichi Saito, Tokyo (JP); Koji Tabata, Tokyo (JP)

(73) Assignee: ASAHI GLASS COMPANY, LIMITED, Tokyo (JP)

( * ) Notice: Subject to any disclaimer, the term of this patent is extended or adjusted under 35 U.S.C. 154(b) by 178 days.

(21) Appl. No.: 13/903,590

(22) Filed: May 28, 2013

(65) Prior Publication Data

US 2013/0257663 A1 Oct. 3, 2013

Related U.S. Application Data

(63) Continuation of application No. PCT/JP2011/077103, filed on Nov. 24, 2011.

(30) Foreign Application Priority Data

Nov. 29, 2010 (JP) ..... 2010-265619

(51) Int. Cl.
*H01Q 1/32* (2006.01)
*H01Q 1/12* (2006.01)
(Continued)

(52) U.S. Cl.
CPC ..... *H01Q 1/3291* (2013.01); *H01Q 1/1278* (2013.01); *H01Q 5/371* (2015.01); *H01Q 7/00* (2013.01); *H01Q 9/42* (2013.01)

(58) Field of Classification Search
CPC ..... H01Q 1/3291; H01Q 1/1278; H01Q 7/00; H01Q 9/42; H01Q 5/371
USPC ..... 343/711, 712, 713, 704
See application file for complete search history.

(56) References Cited

U.S. PATENT DOCUMENTS 6,201,505 B1 * 3/2001 Terashima et al. ..... 343/713
7,091,914 B2 8/2006 Noguchi et al.
(Continued)

FOREIGN PATENT DOCUMENTS

JP A-S-62-038001 2/1987
JP A-08-265029 10/1996
(Continued)

OTHER PUBLICATIONS

International Search Report PCT/JP2011/077103 dated Feb. 28, 2012.
(Continued)

*Primary Examiner* — Hoanganh Le
(74) *Attorney, Agent, or Firm* — Foley & Lardner LLP

(57) ABSTRACT

A glass antenna includes a shared antenna conductor which meets a first frequency band and a second frequency band higher than the first frequency band and a feeding part connected to the shared antenna conductor. The shared antenna conductor includes a first element extended from the feeding part as a starting point and a second element extended from the first element as a starting point. At least a part of the first element and the second element configure a semi-loop form. When a wavelength in air in a central frequency of the second frequency band is $\lambda_{02}$, a glass shortening coefficient of wavelength is $k_2$ and $\lambda_{g2}=\lambda_{02}\cdot k_2$, a conductor length of the first element is 0.65 $\lambda_{g2}$ or higher and 1.0 $\lambda_{g2}$ or lower, and the shortest distance between a defogger provided in window glass and the shared antenna conductor is 15 mm or longer.

13 Claims, 10 Drawing Sheets

(51) Int. Cl.

| | |
|---|---|
| ***H01Q 7/00*** | (2006.01) |
| ***H01Q 9/42*** | (2006.01) |
| ***H01Q 5/371*** | (2015.01) |

(56) References Cited

U.S. PATENT DOCUMENTS

| | | | | |
|---|---|---|---|---|
| 7,642,976 | B2 | 1/2010 | Taniguchi et al. | |
| 8,330,664 | B2 * | 12/2012 | Tabata et al. | 343/713 |
| 8,564,489 | B2 * | 10/2013 | Tabata et al. | 343/713 |
| 2005/0030235 | A1 | 2/2005 | Noguchi et al. | |
| 2007/0273597 | A1 * | 11/2007 | Noda | 343/713 |
| 2008/0158073 | A1 | 7/2008 | Ibe et al. | |
| 2010/0149055 | A1 | 6/2010 | Shinkawa et al. | |

FOREIGN PATENT DOCUMENTS

| | | | |
|---|---|---|---|
| JP | H09-214228 | A | 8/1997 |
| JP | 2005-026905 | A | 1/2005 |
| JP | A-2007-235717 | | 9/2007 |
| JP | 2008-172627 | A | 7/2008 |
| JP | A-2008-182682 | | 8/2008 |
| JP | A-2009-253677 | | 10/2009 |

OTHER PUBLICATIONS

Extended European Search Report issued in EP 11844334.0 dated May 20, 2015.

* cited by examiner

| | L=10 | L=40 | L=70 | L=80 | L=110 |
|---|---|---|---|---|---|
| AVERAGE VALUE OF MINIMUM ANTENNA GAIN | 42.5 | 39.4 | 39.0 | 38.3 | 38.4 |
| MINIMUM VALUE OF MINIMUM ANTENNA GAIN | 33.6 | 26.0 | 24.7 | 18.1 | 19.1 |

GLASS ANTENNA FOR VEHICLE AND WINDOW GLASS FOR VEHICLE

TECHNICAL FIELD

The present invention relates to a glass antenna for a vehicle provided in window glass. Further, the present invention relates to window glass for a vehicle provided with a glass antenna.

RELATED ART

As a usual technique, a glass antenna is known which takes out reception signals of an FM broadcast wave and an AM broadcast wave from one feeding point (for instance, see patent literature 1). In the glass antenna of the patent literature 1, an antenna conductor for an AM broadcasting band is connected closely to a heater line of a defogger to use a structure in which the heater line of the defogger is also used as a part of the antenna conductor for the AM broadcasting band (see a right section of an upper column on page 4 and FIG. 1 of the patent literature 1).

In order to use the defogger as the antenna conductor for the AM broadcasting band, a choke coil is necessary. The defogger has two bus bars, one of which is connected to a DC power source and the other of which is connected to a ground. The choke coils are inserted respectively between the defogger and the DC power source and between the defogger and the ground. However, in the choke coil applied to the AM broadcasting band, an inductance value needs to be set to a large value so as to obtain high impedance in a low frequency band. Accordingly, a problem arises that the choke coil itself is very large to increase a weight.

As a structure which can delete the choke coil, there is a glass antenna disclosed in patent literature 2. The glass antenna of the patent literature 2 also takes out reception signals of broadcast waves of two different frequency bands from one feeding point like the glass antenna of the patent literature 1. However, the glass antenna of the patent literature 2 uses a structure that an antenna conductor for a low frequency band is separated from a heater line of a defogger (see FIG. 1 of patent literature 2).

The glass antenna of the patent literature 2 can effectively allow a directivity of a high frequency band to come close to a round shape (non-directivity).

LITERATURE OF RELATED ART

Patent Literature

Patent Literature 1: JP-A-62-38001

Patent Literature 2: JP-A-2008-182682

In the glass antenna of the patent literature 2, the directivity of the high frequency band is substantially round in its shape, however, an antenna gain in a specific direction is lower than an antenna gain in other direction. Thus, there is a room for improvement of the antenna gain in the specific direction.

In this point, as a unit for improving an antenna gain of a glass antenna for an FM broadcasting band, a structure is supposed to be used in which an antenna conductor is electrically connected to a defogger. When the antenna conductor is electrically connected to the defogger, a choke coil is necessary. Since the antenna conductor uses in common a low frequency band and a high frequency band, the choke coil for the low frequency band is necessary. Thus, the above-described problems arise.

SUMMARY

Thus, it is an object of the present invention to provide a glass antenna for a vehicle and window glass for a vehicle having the glass antenna which can obtain a reception property that can meet two frequency bands of a low frequency band and a high frequency band without a choke coil for the low frequency band and allow a directivity of the high frequency band to come closer to a round shape.

Means for Solving the Problems

In order to achieve the above object, a glass antenna according to the present invention is a glass antenna for a vehicle provided in window glass of a vehicle, comprising:

a shared antenna conductor which meets a first frequency band and a second frequency band higher than the first frequency band; and a feeding part connected to the shared antenna conductor, wherein the shared antenna conductor includes a first element extended from the feeding part as a starting point and a second element extended from the first element as a starting point, a termination of an extension of the first element and a termination of an extension of the second element are provided to be close to each other so that at least a part of the first element and the second element configure a semi-loop form having a cut-out part in a part of a loop form, when a wavelength in air in a central frequency of the second frequency band is $\lambda_{02}$, a glass shortening coefficient of wavelength is $k_2$ (in this case, $k_2$=0.64) and $\lambda_{g2}=\lambda_{02}\cdot k_2$, a conductor length of the first element is 0.65 $\lambda_{g2}$ or higher and 1.0 $\lambda_{g2}$ or lower, and the shortest distance between a defogger provided in the window glass and the shared antenna conductor is 15 mm or longer.

Further, in order to achieve the above object, a window glass for a vehicle is a window glass for a vehicle provided with the glass antenna for a vehicle.

Effect of the Invention

According to the present invention, it is possible to obtain a reception property that can meet two frequency bands of a low frequency band and a high frequency band without a choke coil for the low frequency band and to allow a directivity of the high frequency band to come closer to a round shape.

DETAILED DESCRIPTION

Figure 1:
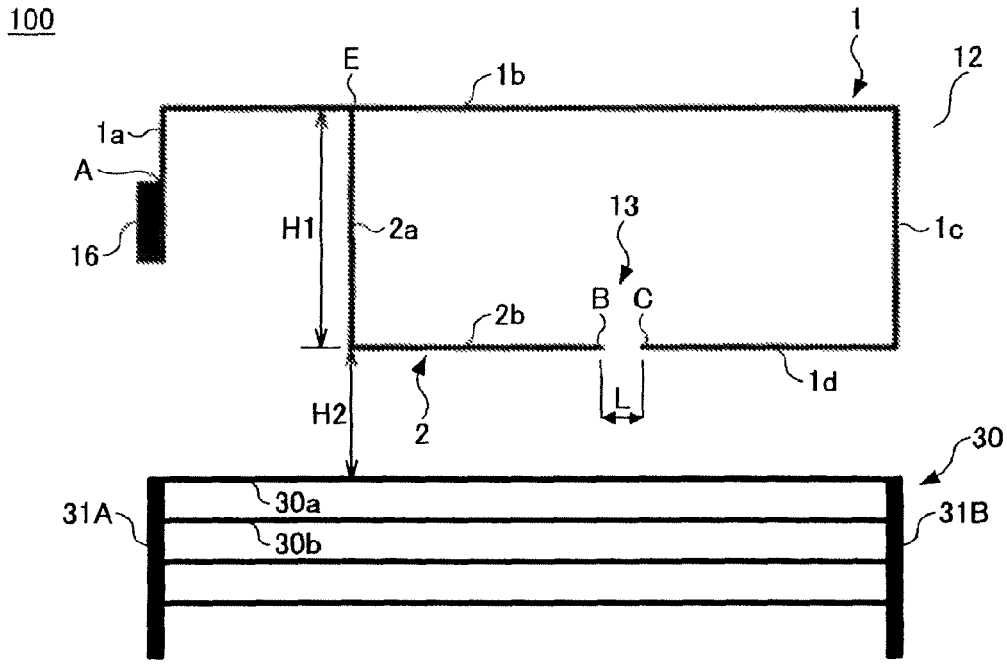
FIG. 1 is a plan view of a glass antenna 100 for a vehicle.

Now, an exemplary embodiment for carrying out the present invention will be described below by referring to the drawings. In the drawings for describing the exemplary embodiment, when there is no description of directions especially, directions are supposed to indicate directions on the drawings. Reference directions on the drawings respectively correspond to directions shown by marks and numeric characters. Further, directions such as parallel and right-angled directions permit such a shift as not to harm effects of the present invention. Further, plan views are respectively views when a surface of glass which is opposed is seen. The plan views are respectively views seen inside a vehicle under a state that window glass according to the present invention is attached to the vehicle, however, they may be referred to as views seen outside the vehicle. Vertical direction in the plan views respectively correspond to a vertical direction of the vehicle. Lower sides of the views respectively correspond to road surface sides. Further, when the window glass is rear window attached to a rear part of the vehicle, a transverse direction on the drawing corresponds to a direction of width of the vehicle.

FIG. 1 is a plan view of a glass antenna 100 for a vehicle of a first exemplary embodiment of the present invention. The glass antenna 100 for the vehicle is an antenna in which a shared antenna conductor and a feeding part are provided in a planar form on window glass 12 provided with a defogger 30 which has a plurality of heater lines extending in parallel. The shared antenna conductor and the feeding part are arranged on an upper side of the defogger 30.

The defogger 30 has an electrical heating type pattern including the plurality of parallel heater lines (upper side heater lines 30*a* and 30*b* are exemplified and lower heater lines are omitted in FIG. 1) and a plurality of belt shaped bus bars (two bus bars 31A and 31B are exemplified in FIG. 1) which feed an electric power to the heater lines. The plurality of heater lines are arranged on the window glass 12 so as to be extended in directions parallel to a horizontal plane (ground surface), for instance, under a state that the window glass 12 is attached to the vehicle. Two or more heater lines which are extended mutually in parallel may be provided. The plurality of heater lines extending in parallel may be short-circuited by a short-circuit line (not shown in FIG. 1) which is extended in a vertical direction. The short-circuit line may be used to adjust an antenna gain of the glass antenna, a length thereof may be suitably adjusted and one or two or more short-circuit lines may be provided. As the bus bars 31A and 31B, in the case of FIG. 1, at least one bus bar is provided respectively in a left side area and a right side area of the window glass 12 in FIG. 1 and extended in a longitudinal direction or in a substantially longitudinal direction of the window glass 12.

The glass antenna 100 is a single pole type antenna including the shared antenna conductor which can meet a reception of radio waves of a first frequency band and a second frequency band higher in its band than the first frequency band and the feeding part 16 connected to the shared antenna conductor. Namely, the glass antenna is an antenna which is shared by one feeding part 16 to feed to the first frequency band and the second frequency band. For instance, as the first frequency band, an AM broadcasting band is exemplified. As the second frequency band, an FM broadcasting band is exemplified.

The feeding part 16 is a feeding point of the shared antenna conductor. When the window glass 12 is attached to an opening part of a vehicle body, the feeding part 16 is arranged on the window glass 12 so as to be located and opposed to a side edge of the opening part of the vehicle body in the direction of width of the vehicle body.

The glass antenna 100 includes, as a pattern of the shared antenna conductor, at least a first element 1 extended from the feeding part 16 as a starting point and a second element 2 extended from the first element 1 as a starting point (namely, from a connecting point E). A termination C of an extension of the first element 1 and a termination B of an extension of the second element 2 are provided to be close to each other so that at least a part of the first element 1 and the second element 2 configure a semi-loop form having a cut-out part 13 in a part of a loop form. Then, when a wavelength in air in a central frequency of the second frequency band is $\lambda_{02}$, a glass shortening coefficient of wavelength is $k_2$ (in this case, $k_2$=0.64) and $\lambda_{g2}=\lambda_{02}\cdot k_2$, the cut-out part 13 is formed so that a conductor length of the first element 1 is 0.65 $\lambda_{g2}$ or higher and 1.0 $\lambda_{g2}$ or lower. Namely, the first element 1 is an element, the conductor length from the connecting point E of which is longer, of the two elements extended from the feeding point 16 as the starting point and branching from the connecting point E. The conductor length from an end point A is 0.65 $\lambda_{g2}$ or higher and 1.0 $\lambda_{g2}$ or lower and the termination C is formed as an opened end.

FIG. 1 shows an example in which the semi-loop form configured by a part of the first element 1 and the second element 2 is a square form including a lower side part opposed to the defogger 30, an upper side part opposed to the lower side, a left side part opposed to the feeding part 16 and a right side part opposed to the left side part.

The first element 1 includes a connection element 1*a* which connects the feeding part 16 to the connecting point E at which it is connected to the second element 2, a partial element 1*b* which is linearly extended rightward from the connecting point E as a starting point to form the upper side part of the semi-loop form, a partial element 1*c* which is linearly extended downward from a termination of a rightward extension of the partial element 1*b* as a starting point to form the right side part of the semi-loop form and a partial element 1*d* which is linearly extended leftward from a termination of a downward extension of the partial element 1*c* as a starting point to form a part of the lower side part of the semi-loop form. The partial element 1*d* is extended to the termination C of the extension of the first element 1.

Further, the second element 2 includes a partial element 2*a* which is linearly extended downward from the connecting point E to the first element 1 as a starting point to form the left side part of the semi-loop form and a partial element 2*b* which is linearly extended rightward from a termination of a downward extension of the partial element 2*a* to from a part of the lower side part of the semi-loop form. The partial element 2*b* is extended to the termination B of the extension of the second element 2.

The termination C of the extension of the first element 1 is not connected to the termination B of the extension of the second element 2, but is allowed to come close thereto to configure the cut-out part 13 of the semi-loop form. FIG. 1 shows an example that the cut-out part 13 is formed in the lower side part of the semi-loop form.

Further, when the wavelength in air in the central frequency of the second frequency band is $\lambda_{02}$, the glass shortening coefficient of wavelength is $k_2$ (in this case, $k_2$=0.64), $\lambda_{g2}=\lambda_{02}\cdot k_2$, and the conductor length L1 of the first element 1 (in the case of FIG. 1, the total of conductor lengths of the elements 1*a* to 1*d*) is 0.65 $\lambda_{g2}$ or higher and 1.0 $\lambda_{g2}$ or lower, and more preferably, 0.70 $\lambda_{g2}$ or higher and 0.95 $\lambda_{g2}$ or lower, a preferable result is obtained from the viewpoint of improvement of the antenna gain of a second broadcasting frequency band.

For instance, when the FM broadcasting band in Japan (76 to 90 MHz) is set as the second broadcasting frequency band, a central frequency thereof is 83 MHz. On the other hand, a central frequency of an FM broadcasting band (88 to 108 MHz) in USA is 98 MHz.

Accordingly, for instance, when an antenna gain of the FM broadcasting band in USA is desired to be improved, assuming that a speed of radio wave is $3.0\times10^8$ m/s, $\lambda_{g2}$ in 98 MHz of the central frequency thereof is 1.959 m. Accordingly, the conductor length L1 of the first element 1 may be adjusted to 1280 mm or larger and 1950 mm or smaller, and more preferably to 1380 mm or larger and 1860 mm or smaller.

Further, when the shared antenna conductor is arranged in the upper side of the defogger 30 so as to ensure the shortest distance H2 of 15 mm or larger (preferably, 25 mm or larger) from the defogger 30, a preferable result is obtained from the viewpoint of improvement of the antenna gain of a first broadcasting frequency band.

In the case of FIG. 1, the shortest distance H2 indicates a distance between the heater line 30*a* corresponding to an uppermost part of the defogger 30 and the partial element 2*b* (or the partial element 1*d*) forming the lower side part of the semi-loop form.

As described above, in the glass antenna having such a form as illustrated in FIG. 1, when the feeding part 16 is electrically connected to a signal path of an external signal processor (for instance, an amplifier to be mounted on a vehicle) through a predetermined electrically conductive member, a reception property can be obtained that can meet two frequency bands of a low frequency band and a high frequency band without a choke coil for the low frequency band and a directivity of the high frequency band can be allowed to come closer to a round shape.

As the above-described electrically conductive member, for instance, a feeding line such as an AV line or a coaxial cable is used. When the AV line is used, the AV line is electrically connected to the feeding part 16. When the coaxial cable is used, an inner conductor of the coaxial cable may be electrically connected to the feeding part 16 and an outer conductor of the coaxial cable may be grounded and connected to the vehicle body. Further, a structure may be used in which a connector for electrically connecting the electrically conductive member such as a conductor connected to the signal processor to the feeding part 16 is mounted on the feeding part 16. By such a connector, the AV line or the inner conductor of the coaxial cable is easily attached to the feeding part 16. Further, a structure may be formed in which a protruding electrically conductive member is provided in the feeding part 16 so that the protruding electrically conductive member comes into contact with and is fitted to a flange of the vehicle body to which the window glass 12 is attached.

A "termination part" may be a terminal point of an extension of the element or a position near the terminal point as a conductor part before the terminal point. Connecting parts of the elements may be connected together with a curvature.

The shared antenna conductor and the feeding part 16 are formed by printing and baking paste including electrically conductive metal such as silver paste, for instance, on an inner side surface of the window glass of the vehicle. However, a forming method of the shared antenna and the feeding part is not limited to the above-described forming method and a linear member or a foil shaped member made of an electrically conductive material such as copper may be formed on an inner side surface or an outer side surface of the window glass of the vehicle, may be bonded to the window glass by a bonding agent or may be provided in an inner part of the window glass itself.

A configuration of the feeding part 16 may be determined in accordance with a form of a mounting surface of the above-described electrically conductive member or the connector or a space of the mounting surface thereof. For instance, square forms such as a square form, a substantially square form, a rectangular form and a substantially rectangular form or polygonal forms are preferable in view of mounting. Circular forms may be used, such as a circular form, a substantially circular form, an elliptic form and a substantially elliptic form.

A conductor layer formed with each antenna conductor may be provided in an inner part or a surface of a synthetic resin film and the synthetic resin film with the conductor layer may be formed on the inner side surface or the outer side surface of a window glass plate of a vehicle to form a glass antenna. Further, a flexible circuit board having each antenna conductor formed may be provided on the inner side surface or the outer side surface of the window glass of the vehicle to form the glass antenna.

A shield film may be formed on a surface of the window glass 12 and the feeding part and a part or an entire part of the antenna conductor may be provided on the shield film. As the shield film, ceramics such as a black ceramic film may be exemplified. In this case, when the part of the antenna conductor is seen from an outer side of the of the window glass of the vehicle, the part of the antenna conductor provided on the shield film is not seen from the outer side of the window glass of the vehicle due to the shield film, so that the window glass excellent in its design is obtained. In the structure shown in the drawing, since the feeding part and a part of the antenna conductor are formed on the shield film (between an edge of the shield film and an edge of the window glass 12), only a thin straight line part of the conductor is seen outside the vehicle, which is preferable in view of design.

When the shortest distance L of the first element 1 and the second element 2 of the cut-out part 13 is set to 2 mm or longer and 75 mm or shorter, more preferably to 2 mm or longer and 60 mm or shorter, and more preferably to 2 mm or longer and 15 mm or shorter, a preferable result is obtained from the viewpoint of improvement of the antenna gain of the high frequency band and a non-directivity of the high frequency band. A lower limit value "2 mm" of the shortest distance L is a limit accuracy with which the antenna conductor can be printed on the window glass.

The semi-loop form illustrated in FIG. 1 is configured as the square form. However, even when the semi-loop form is circular, elliptic or polygonal, a preferred result is obtained from the viewpoint of improvement of the antenna gains of both the frequency bands and a non-directivity of the high frequency band. Further, the cut-out part 13 illustrated in FIG. 1 is formed in the lower side part opposed to the square shaped defogger 30. However, even when the cut-out part may be formed in the partial element 1*c* forming the right side part, a preferred result is obtained from the viewpoint of improvement of the antenna gains of both the frequency bands and a non-directivity of the high frequency band.

When a height (a conductor length of the partial element 2*a* corresponding to the left side part of the semi-loop form in FIG. 1) H1 of the semi-loop form shown in FIG. 1 is set to 60 mm or longer and 150 mm or shorter, and more preferably, to 90 mm or longer and 150 mm or shorter, a preferred result is obtained from the viewpoint of improvement of the antenna gain of the low frequency band. A lower limit value "60 mm" of the height H1 of the semi-loop form is a length necessary for ensuring a minimum antenna gain of the first frequency band. An upper limit value "150 mm" of the height H1 of the semi-loop form is a length determined by considering a distance between an upper edge of the window glass 12 and an uppermost part of the defogger 30.

Figure 2:
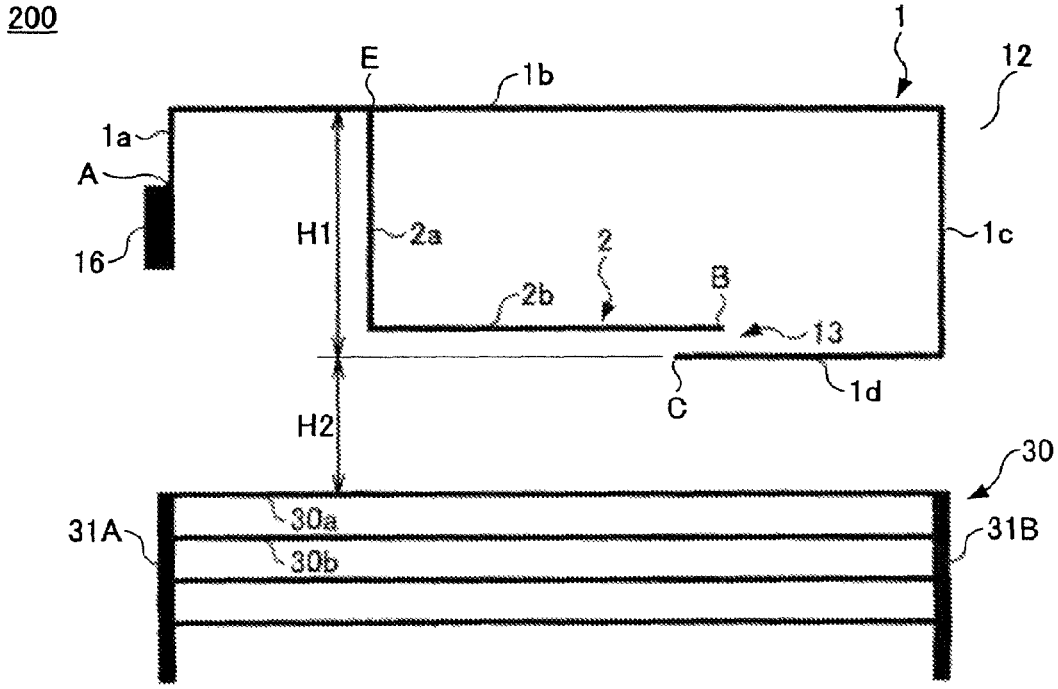
FIG. 2 is a plan view of a glass antenna 200 for a vehicle.

FIG. 2 is a plan view of a glass antenna 200 for a vehicle of a second exemplary embodiment of the present invention. An explanation of the same parts as those of the above-described glass antenna will be omitted.

As shown in FIG. 2, a cut-out part 13 of a semi-loop form may be formed. Namely, in a shared antenna conductor, a partial element 2*b* and a partial element 1*d* hold a predetermined space (for instance, 10 mm) in a vertical direction and respectively have parallel extending parts which extend in parallel with each other. By providing such parallel extending parts, a property (impedance or the like) of an antenna can be adjusted.

Figure 3:
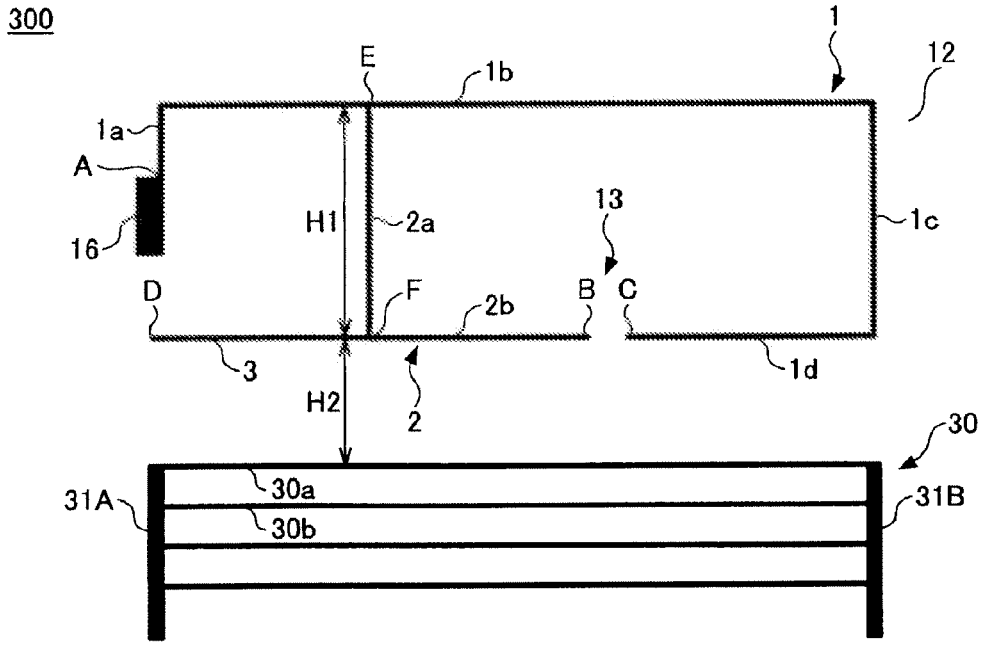
FIG. 3 is a plan view of a glass antenna 300 for a vehicle.

FIG. 3 is a plan view of a glass antenna 300 for a vehicle of a third exemplary embodiment of the present invention. An explanation of the same parts as those of the above-described glass antenna will be omitted. In the case of FIG. 3, a shared antenna conductor includes a first extension element 3 extended leftward from a lower side part of a semi-loop form as a starting point. Since the first extension element is included, a preferred result is obtained from the viewpoint of a non-directivity of a high frequency band.

The first extension element 3 shown in FIG. 3 is linearly extended leftward from a connecting point F of a partial element 2*b* which forms the lower side part and a partial element 2*a* which forms a left side part as a starting point. The first extension element 3 is extended to a termination D of a leftward extension of the first extension element 3.

For instance, assuming that a high frequency band is an FM broadcasting band, and dimensions (unit: mm) of parts of the glass antenna 300 shown in FIG. 3 are respectively set in such a way as described below;

A conductor length between A and B: 710

A conductor length between A and C: 1540

A conductor length between A and D: 750, directivity can be allowed to come close to a round shape.

Figure 4:
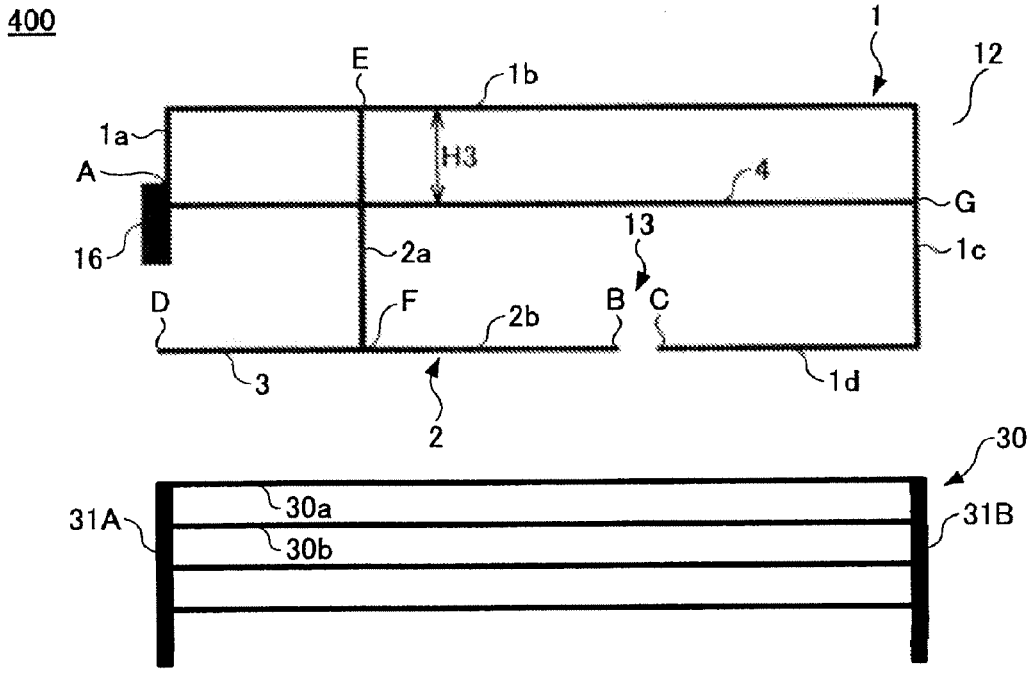
FIG. 4 is a plan view of a glass antenna 400 for a vehicle.

FIG. 4 is a plan view of a glass antenna 400 for a vehicle of a fourth exemplary embodiment of the present invention. An explanation of the same structures as those of the above-described glass antenna will be omitted. In the case of FIG. 4, in addition to the structure of FIG. 3, a shared antenna conductor includes a first auxiliary element 4 connected to a right side part, the left side part of the semi-loop form and a feeding part 16 and parallel to or substantially parallel to the lower side part.

By adding the first auxiliary element 4, a resistance value between A and C can be lowered and an average antenna gain can be improved which is calculated by averaging antenna gains respectively of frequencies of a high frequency band. A clearance H3 between a partial element 1*b* and the first auxiliary element 4 is preferably set to 2 mm or longer and 40 mm or shorter to improve the average antenna gain.

The first auxiliary element 4 shown in FIG. 4 is connected to a partial element 1*c* which forms the right side part, a partial element 2*a* which forms the left side part and the feeding part 16. The first auxiliary element 4 is linearly extended rightward from the feeding part 16 as a starting point, intersects the partial element 2*a* and is extended to a point G on the partial element 1*c*.

For instance, assuming that a high frequency band is an FM broadcasting band, and dimensions (unit: mm) of parts of the glass antenna 400 shown in FIG. 4 are respectively set in such a way as described below;

A conductor length between A and B: 710

A conductor length between A and C: 1540

A conductor length between A and D: 750,

Clearance H3: 30, the average antenna gain can be improved.

Figure 5:
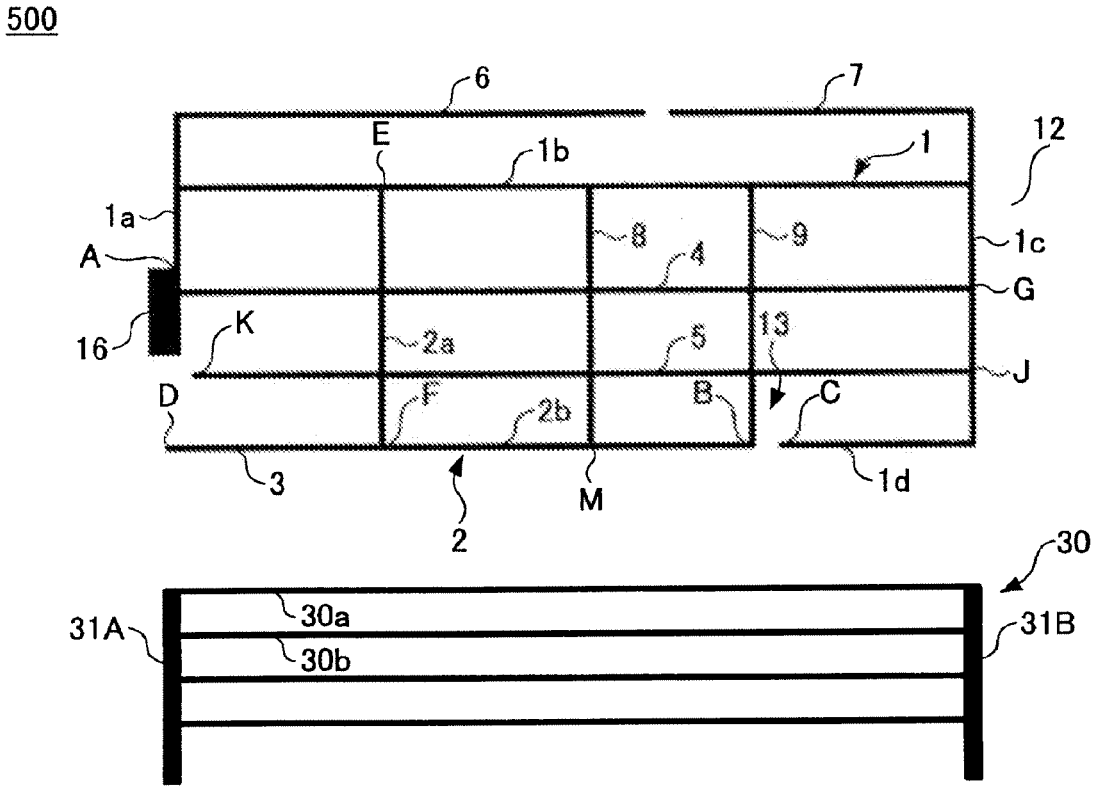
FIG. 5 is a plan view of a glass antenna 500 for a vehicle.

FIG. 5 is a plan view of a glass antenna 500 for a vehicle of a fifth exemplary embodiment of the present invention. An explanation of the same structures as those of the above-described glass antenna will be omitted. In the case of FIG. 5, in addition to the structure of FIG. 3, a shared antenna conductor includes a second auxiliary element 5, second extension elements 6 and 7 and third auxiliary elements 8 and 9.

The second auxiliary element 5 is linearly extended leftward from a point J on a partial element 1*c* which forms a right side part of a semi-loop form as a starting point, connected to a partial element 2*a* which forms a left side part and extended to a termination K of a leftward extension of the partial element 2*a*. By adding the second auxiliary element 5, an antenna gain of a low frequency band can be improved not so as to give an influence to a property of an antenna gain of a high frequency band.

Further, the second extension element is extended upward from a first element as a starting point, and then extended rightward or leftward. In FIG. 5, as the second extension element, the extension elements 6 and 7 are shown. The extension element 6 is extended upward from a connection element 1*a* as the first element as the starting point, and then extended rightward. The extension element 7 is extended upward from a partial element 1*b* which forms an upper side part of the semi-loop form as a starting point, and then extended leftward. By the second extension elements 6 and 7, the antenna gain of the low frequency band can be improved not so as to give an influence to the property of the antenna gain of the high frequency band.

The third auxiliary element is connected to a lower side part and the upper side part and extended in parallel with or substantially in parallel with the right side part or the left side part. In FIG. 5, as the third auxiliary element, the auxiliary elements 8 and 9 are shown. The auxiliary element 8 is linearly extended upward from a point M on a partial element 2*b* which forms a part of the lower side part of the semi-loop form as a starting point to connect the partial element 1*b* which forms the upper side part of the semi-loop form to the partial element 2*b*. The auxiliary element 9 is an element for connecting the partial element 1*b* to a termination B of a second element 2. By the third auxiliary elements 8 and 9, the antenna gain of the low frequency band can be improved not so as to give an influence to the property of the antenna gain of the high frequency band.

EXAMPLE

In a glass antenna for a motor vehicle which is manufactured by attaching the above-described form of the glass antenna to rear window of an actual vehicle, actually measured results of frequency properties will be describe below.

A conductor width of each element in this example is set to 0.8 mm. Further, a size of a feeding part 16 is set to 27 mm in a vertical direction and to 13 mm in a transverse direction.

An antenna gain is actually measured by attaching window glass for the motor vehicle having the glass antenna to a window frame of the motor vehicle on a turntable. A connector is attached to a feeding part. A feeding line is connected to the connector to connect the feeding part 16 to an amplifier through the feeding line. The amplifier has a gain of 8 dB. Further, the amplifier is connected by a tuner and the feeding line (1.5 C-2V 4.5 m). A radio wave (a polarized wave has a plane of polarization of frequency of 88 to 108 MHz of which is inclined at 45° from a horizontal plane) is applied from a horizontal direction to the window glass while the turntable is turned to change an incident angle of the radio wave to the window glass.

The antenna gain is measured in such a way that a vehicle center of the motor vehicle to which the glass of the glass antenna is attached is set to a center of the turntable and the radio wave of a predetermined frequency is transmitted while the motor vehicle is turned by 360°. Data of the antenna gain is measured for each rotating angle of 1° and for each MHz in an irradiation frequency band of 88 to 108 MHz. A measurement is carried out in a direction where an angle of elevation formed by a transmitting position of the radio wave and an antenna conductor is in a substantially horizontal direction (assuming that in a plane parallel to the ground, an angle of elevation=0°, and in a direction of zenith, an angle of elevation=90°, a direction of the angle of elevation=0°). In below-illustrated graphs, results are mentioned which are obtained by measuring an antenna to be measured in an electric field atmosphere where an antenna terminal voltage induced in a reference half-wave dipole antenna is 60 dBμV.

Example 1

Figure 6:
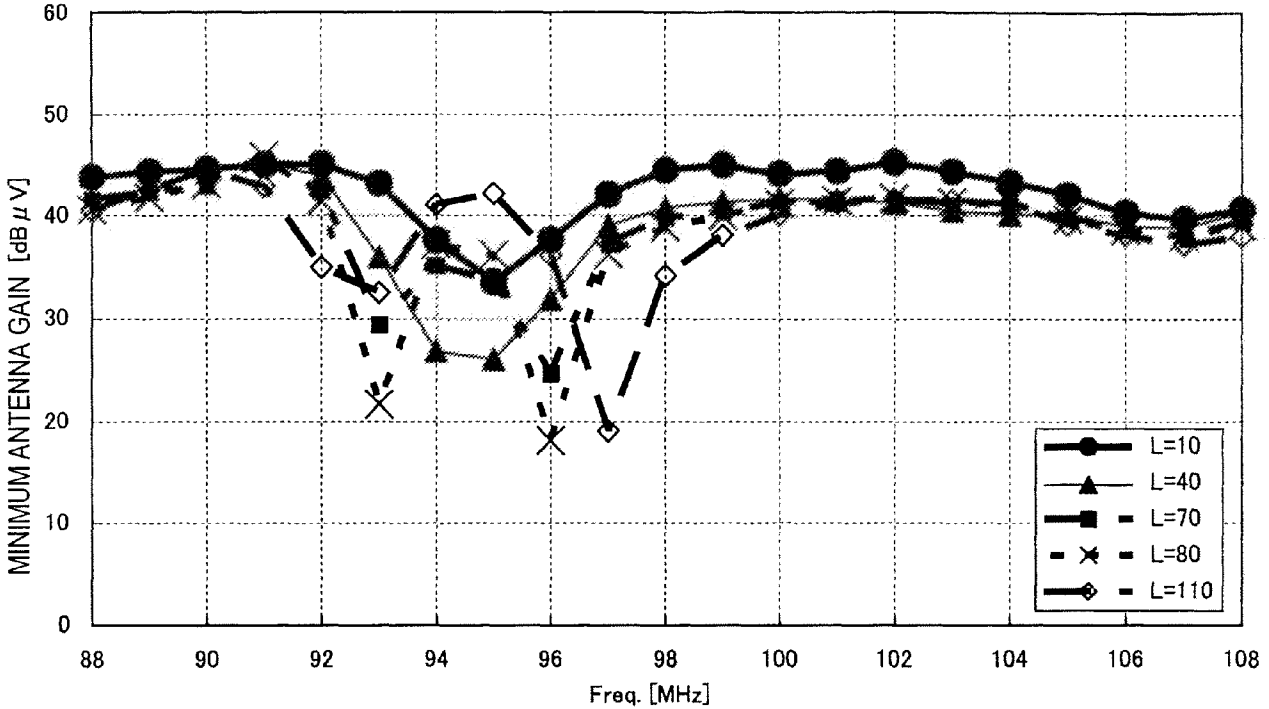
FIG. 6 is a frequency property view of the minimum antenna gain when the shortest distance L of a first element and a second element is changed.
Figure 7:
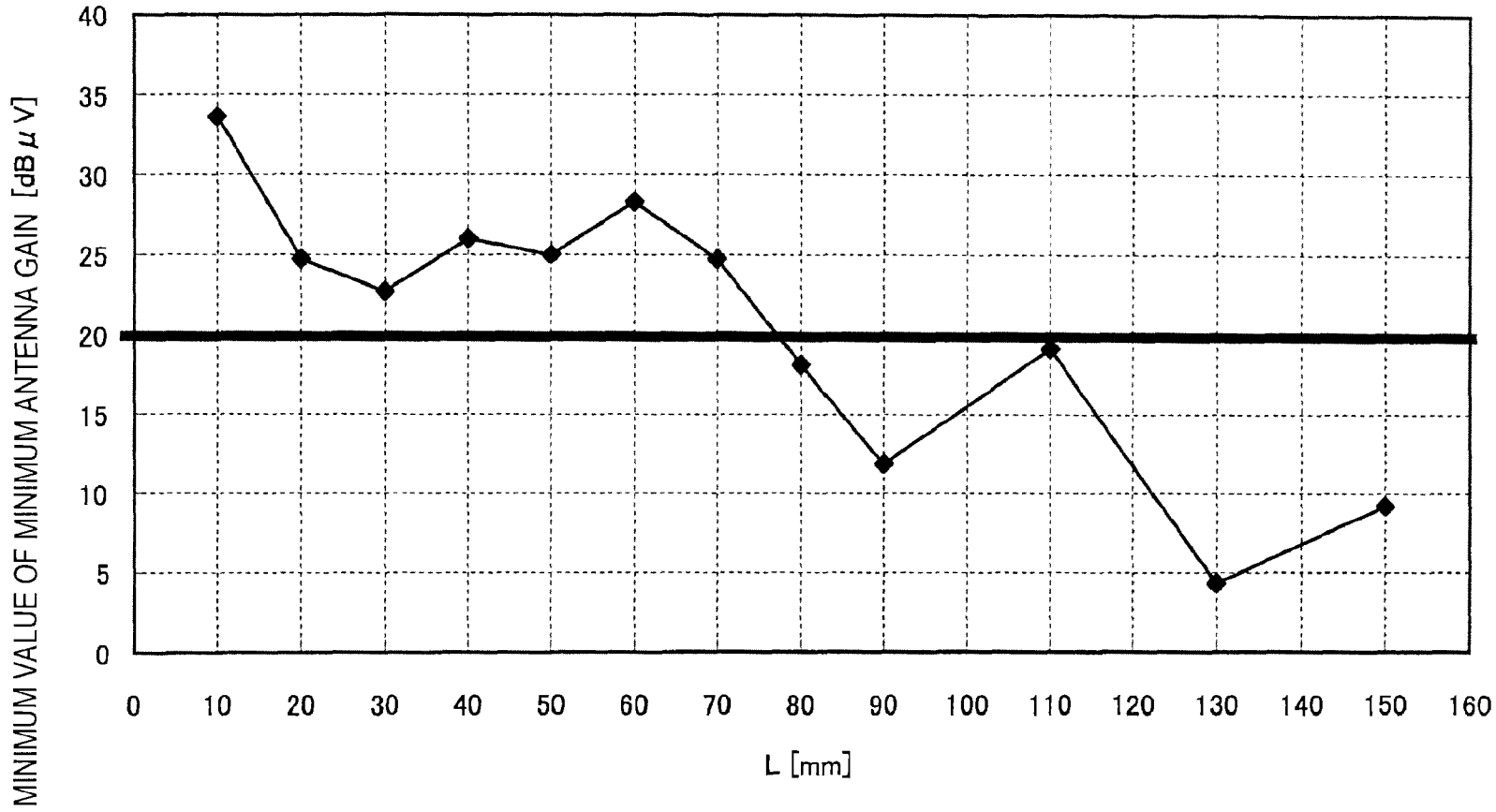
FIG. 7 is a view of a relation between the shortest distance L of the first element and the second element and the minimum value of the minimum antenna gain.

FIGS. 6 and 7 show actually measured data of antenna gains, in the high frequency glass antenna for the motor vehicle manufactured by attaching the form of the glass antenna 100 shown in FIG. 1 to the rear window of the actual vehicle, when the shortest distance L between the first element 1 and the second element 2 of the cut-out part 13 is changed by adjusting a conductor length between E and B while a conductor length between A and C and the height H1 of the semi-loop form are maintained to be constant. Dimensions (unit: mm) of parts respectively of the glass antenna 100 when the antenna gains shown in FIGS. 6 and 7 are measured are set as described below.

A conductor length between A and C: 1540
H1: 90

An axis of ordinate in FIG. 6 shows the smallest antenna gain (a minimum antenna gain) in antenna gains of directions respectively within 360°. Namely, the minimum antenna gain shows an antenna gain in a direction where the antenna gain is the lowest. An upper stage of a table in FIG. 6 shows average values of the minimum antenna gains in 88 to 108 MHz (an average value of the minimum antenna gain). A lower stage of the table in FIG. 6 shows minimum values of the minimum antenna gains in 88 to 108 MHz (a minimum value of the minimum antenna gain).

FIG. 7 shows a relation between the shortest distance L and the minimum value of the minimum antenna gain. According to FIG. 7, when the shortest distance L is adjusted to 10 mm or longer and 75 mm or shorter, the minimum value of the minimum antenna gain in an FM broadcasting band (88 to 108 MHz) in USA can be improved.

Example 2

Figure 9:
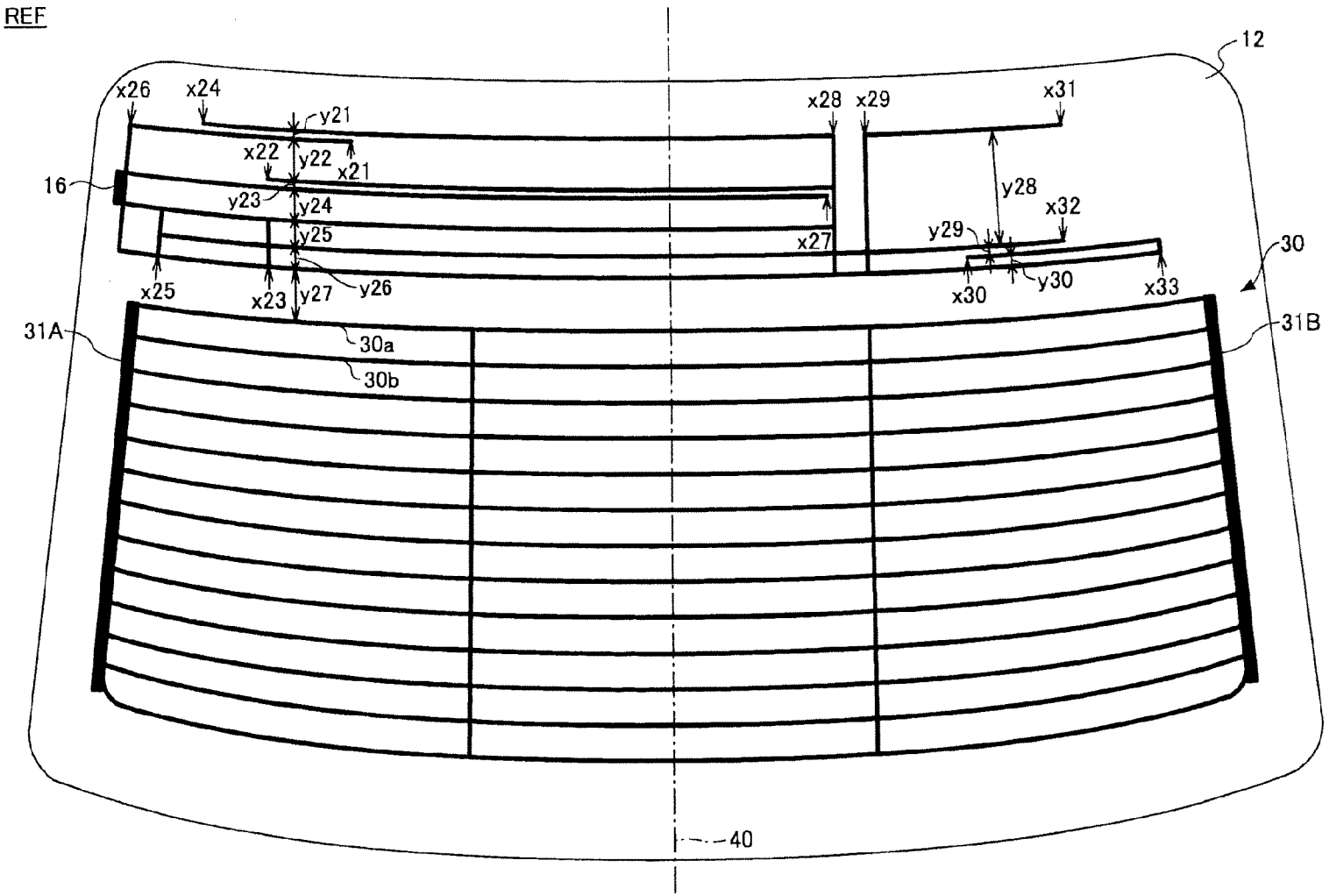
FIG. 9 is a plan view of a glass antenna REF for a vehicle.
Figure 10:
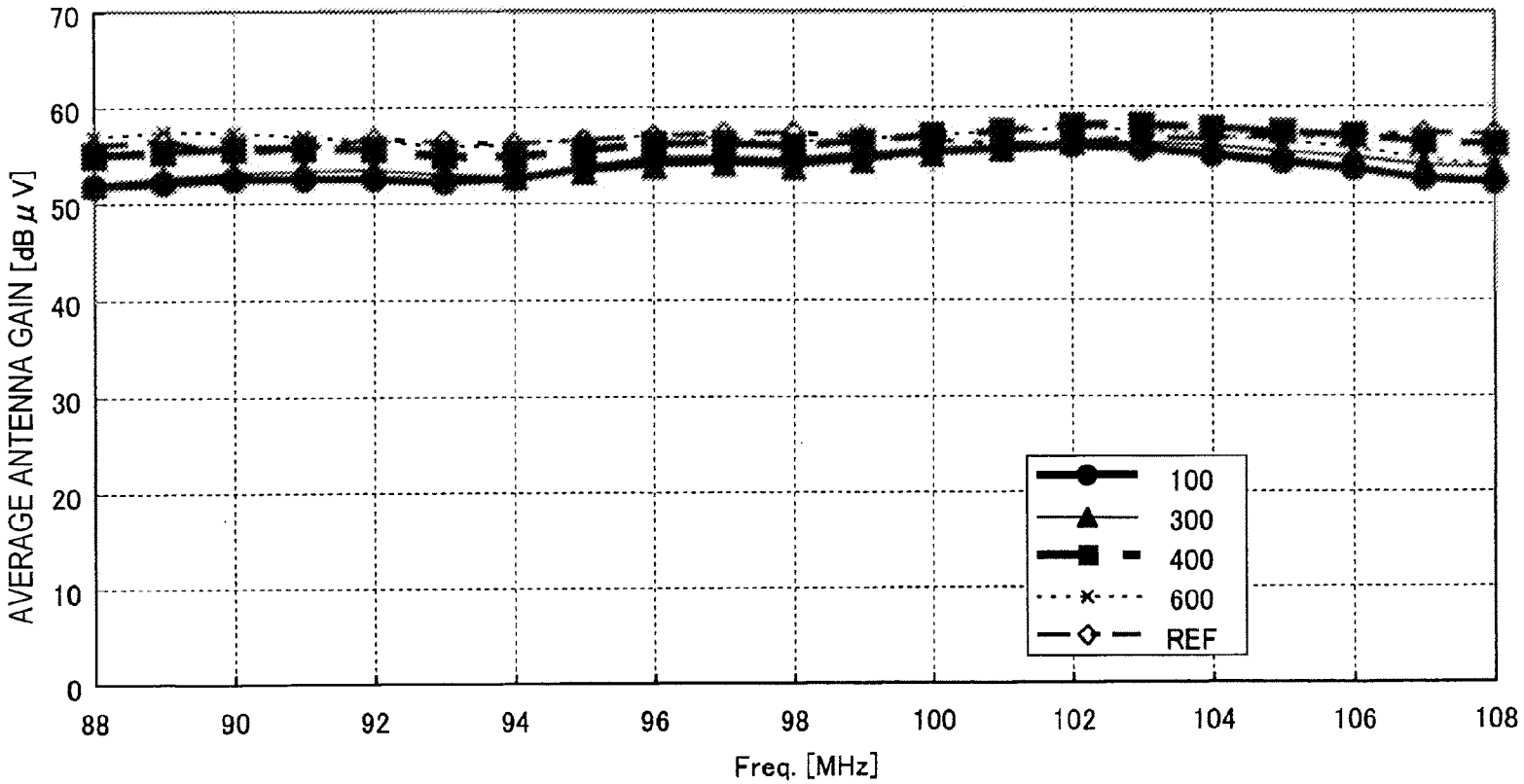
FIG. 10 is a frequency property view of the average antenna gain.
Figure 11:
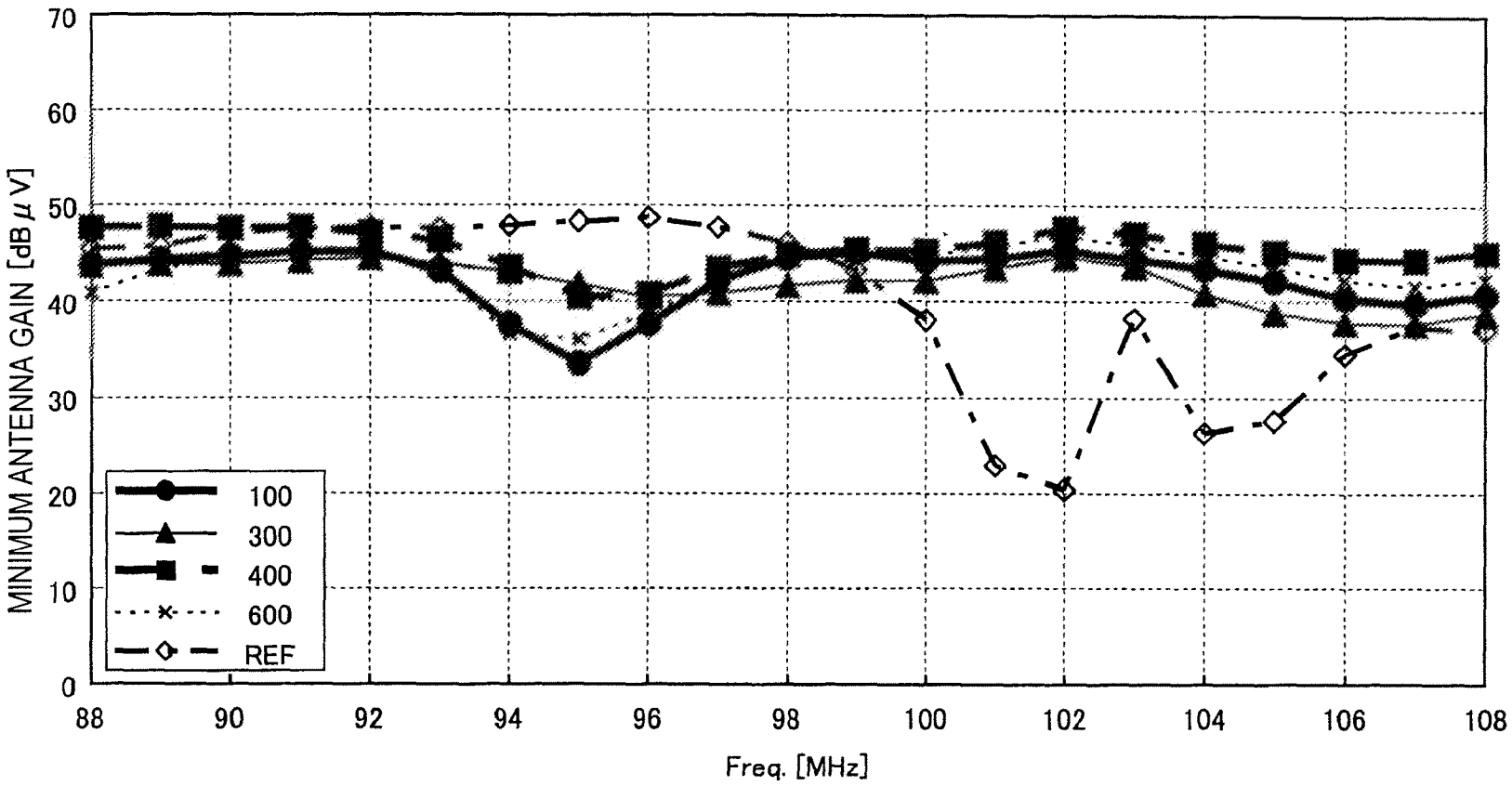
FIG. 11 is a frequency property view of the minimum antenna gain.
Figure 12:
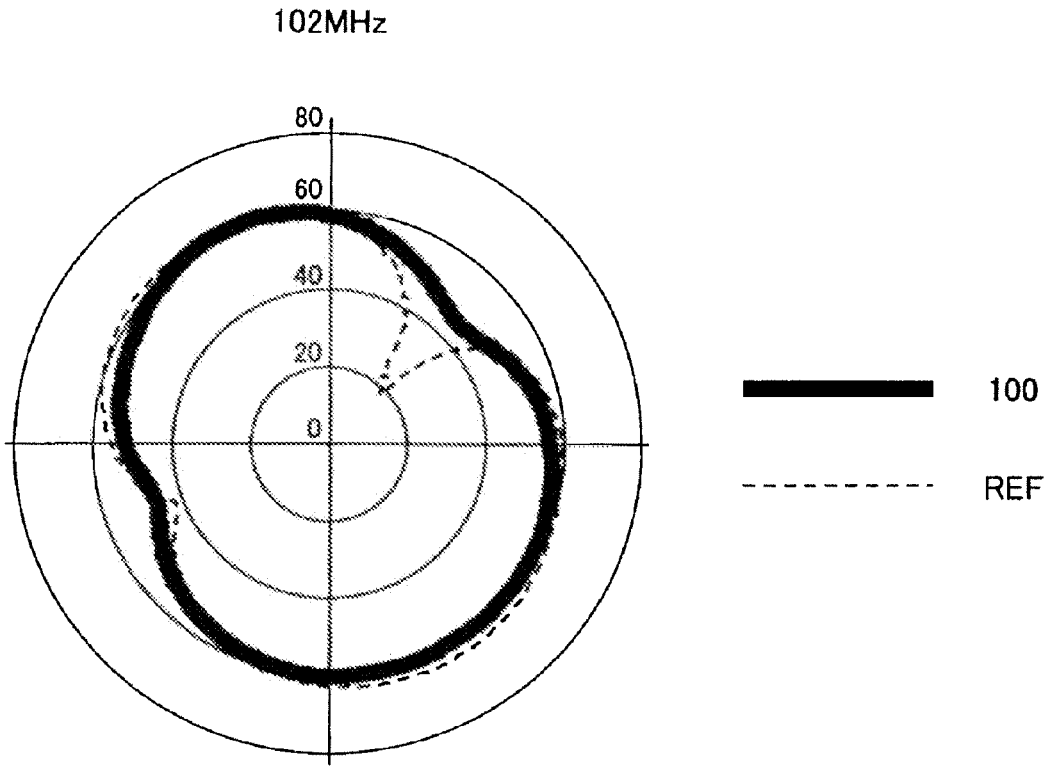
FIG. 12 is a directional characteristic view of directivities in 102 MHz.

FIGS. 10 and 11 show actually measured data of antenna gains of the glass antennas 100 (FIG. 1), 300 (FIG. 3), 400 (FIGS. 4) and 600 (FIG. 8) as the exemplary embodiments of the present invention and a usual glass antenna REF (FIG. 9) as a comparative example. FIG. 12 is a directional characteristic view of directivities of the glass antenna 100 and the glass antenna REF. The glass antenna 600 is an improved form of the glass antenna 500 (FIG. 5). In the glass antenna REF, the glass antenna disclosed in the above-described patent literature 2 which has two inputs (two feeding parts) is changed to a glass antenna having one input (one feeding part).

Dimensions (unit: mm) of parts respectively of the glass antenna 100 (FIG. 1) when the antenna gains shown in FIGS. 10 to 12 are measured are set as described below.

A conductor length between A and C: 1540
A conductor length between A and B: 710
H1: 90
L: 10

Dimensions (unit: mm) of parts respectively of the glass antenna 300 (FIG. 3) when the antenna gains shown in FIGS. 10 and 11 are measured are set as described below.

A conductor length between A and C: 1540
A conductor length between A and B: 710
H1: 90
L: 10
A length between A and D: 750

Dimensions (unit: mm) of parts respectively of the glass antenna 400 (FIG. 4) when the antenna gains shown in FIGS. 10 and 11 are measured are set as described below.

A conductor length between A and C: 1540
A conductor length between A and B: 710
H1: 90
L: 10
A length between A and D: 750
H3: 30

Dimensions (unit: mm) of parts respectively of the glass antenna 600 (FIG. 8) when the antenna gains shown in FIGS. 10 and 11 are measured are set as described below.

x1: 200
x2: 500
x3: 30
x4: 525
x5: 200
x6: 350
x7: 360
x8: 500
y1: 30
y2: 30
y3: 30
y4: 30
y5: 45

Dimensions (unit: mm) of parts respectively of the glass antenna REF (FIG. 9) when the antenna gains shown in FIGS. 10 to 12 are measured are set as described below.

x21: 320
x22: 400
x23: 400
x24: 400
x25: 490
x26: 525
x27: 160
x28: 170
x29: 200
x30: 300
x31: 400
x32: 400
x33: 500
y21: 10
y22: 25 y23: 10
y24: 25
y25: 25
y26: 25
y27: 45
y28: 95
y29: 15
y30: 10

Figure 8:
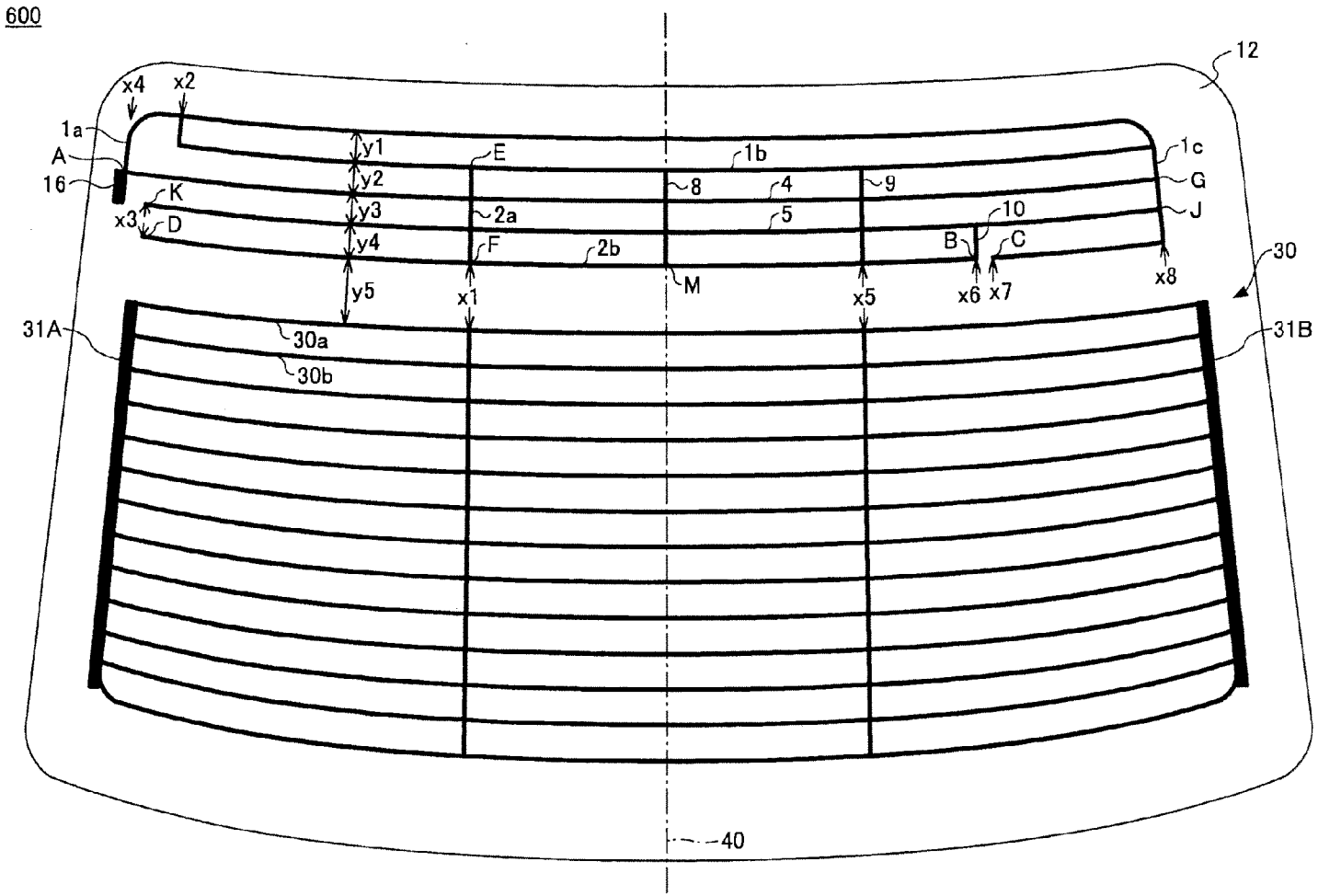
FIG. 8 is a plan view of a glass antenna 600 for a vehicle.

Since "x" ( represents figures) is shown by an arrow mark in FIGS. 8 and 9, the "x" shows the shortest distance to a central line 40 of a defogger 30. The central line 40 is a straight line virtually drawn in a vertical direction. "y" shows the shortest distance between conductors in the vertical direction.

An axis of ordinate in FIG. 10 shows an average value (an average antenna gain) of antenna gains in each of directions within 360°. An axis of ordinate in FIG. 11 shows the smallest antenna gain (a minimum antenna gain) in the antenna gains in each of the directions within 360°.

When the average antenna gains of FIG. 10 are observed, gain differences between the glass antennas are respectively small. However, when the minimum antenna gains of FIG. 11 are observed, the glass antenna according to the present invention can improve the minimum antenna gain more than that of the glass antenna REF in a band of about 100 MHz or higher in an FM broadcasting band. As a result, as shown in FIG. 12, as compared with the glass antenna REF with which the antenna gain is lowered in a specific direction, the antenna gain is improved in the specific direction in the glass antenna 100. Accordingly, in the glass antenna according to the present invention, since the directivity can be allowed to come close to a round shape as much as possible, a radio wave can be prevented from being hardly received depending on an arriving direction of the radio wave.

INDUSTRIAL APPLICABILITY

In the present invention, the first frequency band is preferably applied to, for instance, an MF band of 300 k to 3 MHz. As a use of a radio wave of the MF band, an AM radio broadcasting (520 to 1700 kHz) is exemplified. Further, in the present invention, the second frequency band is preferably applied to, for instance, a VHF band of 30M to 0.3 GHz. As a use of a radio wave of the VHF band, are exemplified an FM broadcasting band (76 to 90 MHz) in Japan, an FM broadcasting band (88 to 108 MHz) in USA and a television VHF band (90 to 108 MHz, 170 to 222 MHz). Further, in the present invention, the second frequency band is preferably applied to, for instance, to a low frequency side of a UHF band of 0.3 G to 3 GHz. As a use of a radio wave of the low frequency side of the UHF band, are exemplified a keyless entry system (300 to 450 MHz) for a vehicle and 800 MHz band (810 to 960 MHz) for a telephone of a motor vehicle.

This application is described in detail by referring to the specific exemplary embodiments, however, it is to be understood to a person with ordinary skill in the art that various change or modifications may be made without deviating from the spirit and scope of the present invention.

This application is based on Japanese Patent Application (JPA. No. 2010-265619) filed on Nov. 29, 2010 and its contents arc incorporated herein as a reference.

DESCRIPTION OF REFERENCE NUMERALS AND SIGNS

1: first element
2: second element
3: first extension element
4: first auxiliary element
5: second auxiliary element
6, 7: second extension element
8, 9: third auxiliary element
12: window glass
13: cut-out part
16: feeding part
30: defogger
100 to 600, REF: glass antenna for vehicle

What is claimed is:

1. A glass antenna for a vehicle provided in window glass of a vehicle, comprising:

a shared antenna conductor which meets a first frequency band and a second frequency band higher than the first frequency band; and a feeding part connected to the shared antenna conductor, wherein the shared antenna conductor includes a first element extended from the feeding part as a starting point and a second element extended from the first element as a starting point, a termination of an extension of the first element and a termination of an extension of the second element are provided to be close to each other so that at least a part of the first element and the second element configure a semi-loop form having a cut-out part in a part of a loop form, when a wavelength in air in a central frequency of the second frequency band is $\lambda_{02}$, a glass shortening coefficient of wavelength is $k_2$ (in this case, $k_2$=0.64) and $\lambda_{g2}=\lambda_{02}\cdot k_2$, a conductor length of the first element is 0.65 $\lambda_{g2}$ or higher and 1.0 $\lambda_{g2}$ or lower, and the shortest distance between a defogger provided in the window glass and the shared antenna conductor is 15 mm or longer.

2. The glass antenna for a vehicle according to claim 1, wherein the shortest distance between the first element and the second element of the cut-out part is 2 mm or longer and 75 mm or shorter.

3. The glass antenna for a vehicle according to claim 1, wherein the semi-loop form is a square form including a lower side part opposed to the defogger, an upper side part opposed to the lower side, a left side part opposed to the feeding part and a right side part opposed to the left side part.

4. The glass antenna for a vehicle according to claim 3, wherein the cut-out part is formed in the lower side part.

5. The glass antenna for a vehicle according to claim 3, wherein a length of the left side part is 60 mm or longer and 150 mm or shorter.

6. The glass antenna for a vehicle according to claim 3, wherein the shared antenna conductor includes a first extension element extended leftward from the lower side part as a starting point.

7. The glass antenna for a vehicle according to claim 3, wherein the shared antenna conductor includes a first auxiliary element connected to the right side part, the left side part and the feeding part and parallel to or substantially parallel to the lower side part.

8. The glass antenna for a vehicle according to claim 3, wherein the shared antenna conductor includes a second auxiliary element connected to the right side part and the left side part and parallel to or substantially parallel to the lower side part.

9. The glass antenna for a vehicle according to claim 3, wherein the shared antenna conductor includes a second extension element extended upward from the first element as a starting point, and then extended rightward or leftward.

10. The glass antenna for a vehicle according to claim 3, wherein the shared antenna conductor includes a third auxiliary element connected to the lower side part and the upper side part and parallel to or substantially parallel to the right side part or the left side part.

11. The glass for a vehicle according to claim 1, wherein the second frequency band is located from 76 MHz to 108 MHz.

12. The glass for a vehicle according to claim 1, wherein the first frequency band is located from 520 kHz to 1700 MHz.

13. A window glass for a vehicle provided with a glass antenna for a vehicle according to claim 1.

* * * * *